US009914142B2

(12) United States Patent
Quintard et al.

(10) Patent No.: US 9,914,142 B2
(45) Date of Patent: Mar. 13, 2018

(54) DEVICE FOR DISPENSING FLUID JETS WITHOUT A ROTATING JOINT

(75) Inventors: Jacques Quintard, Presles (FR); Frédéric Richard, Parmain (FR); Charles Truchot, Poissy (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 1715 days.

(21) Appl. No.: 13/386,342

(22) PCT Filed: Jun. 24, 2010

(86) PCT No.: PCT/FR2010/051291

§ 371 (c)(1),
(2), (4) Date: Jan. 20, 2012

(87) PCT Pub. No.: WO2011/010030

PCT Pub. Date: Jan. 27, 2011

(65) Prior Publication Data

US 2012/0222708 A1 Sep. 6, 2012

(30) Foreign Application Priority Data

Jul. 21, 2009 (FR) ..... 09 55058

(51) Int. Cl.
*B05B 13/04* (2006.01)
*B05B 3/00* (2006.01)
(Continued)

(52) U.S. Cl.
CPC ..... *B05B 13/0421* (2013.01); *B05B 15/066* (2013.01); *B24C 1/003* (2013.01);
(Continued)

(58) Field of Classification Search
CPC ..... B05B 9/0403; B05B 13/0421; B05B 13/0431; B05B 15/066; B24C 1/003; B24C 3/04; B21B 45/04
See application file for complete search history.

(56) References Cited

U.S. PATENT DOCUMENTS 4,369,850 A 1/1983 Barker
4,736,808 A * 4/1988 James et al. ..... 175/135
(Continued)

FOREIGN PATENT DOCUMENTS

DE 4142740 6/1993
DE 10236266 2/2003
(Continued)

OTHER PUBLICATIONS

French Search Report, FR 0955058, dated Jan. 6, 2010.
(Continued)

*Primary Examiner* — Alexander Markoff
(74) *Attorney, Agent, or Firm* — Elwood L. Haynes; Allen E. White

(57) ABSTRACT

The disclosure relates to a device for dispensing one or more jets of cryogenic fluid, particularly liquid nitrogen, comprising a fluid conveying pipeline feeding one or more fluid dispensing nozzles arranged at the downstream end of said pipeline, and a motor collaborating with the fluid conveying pipeline via a rotary transmission shaft and a transmission mechanism.

10 Claims, 7 Drawing Sheets

(51) Int. Cl.

| | |
|---|---|
| ***B08B 5/02*** | (2006.01) |
| ***B24C 1/00*** | (2006.01) |
| ***B24C 3/04*** | (2006.01) |
| ***B05B 15/06*** | (2006.01) |
| *B05B 9/04* | (2006.01) |
| *B21B 45/04* | (2006.01) |

(52) U.S. Cl.
CPC ..... *B24C 3/04* (2013.01); *B05B 9/0403* (2013.01); *B05B 13/0431* (2013.01); *B21B 45/04* (2013.01)

(56) References Cited

U.S. PATENT DOCUMENTS

| | | | | |
|---|---|---|---|---|
| 5,203,842 | A | 4/1993 | Mark et al. | |
| 5,533,673 | A * | 7/1996 | Wilson et al. | 239/227 |
| 5,794,854 | A | 8/1998 | Yie | |
| 6,758,418 | B2 | 7/2004 | Romanin et al. | |
| 7,310,955 | B2 | 12/2007 | Hume et al. | |
| 7,316,363 | B2 | 1/2008 | Hume et al. | |
| 2001/0038039 | A1 | 11/2001 | Schultz et al. | |
| 2002/0109017 | A1 | 8/2002 | Rogers et al. | |
| 2006/0053165 | A1 | 3/2006 | Hume et al. | |

FOREIGN PATENT DOCUMENTS

| | | |
|---|---|---|
| DE | 102005001169 | 6/2006 |
| WO | WO 9011134 | 10/1990 |

OTHER PUBLICATIONS

International Search Report, PCT/FR2010/051291, dated Oct. 12, 2010.
International Written Opinion, PCT/FR2010/051291, dated Feb. 7, 2012.

* cited by examiner

DEVICE FOR DISPENSING FLUID JETS WITHOUT A ROTATING JOINT

CROSS REFERENCE TO RELATED APPLICATIONS

This application is a 371 of International PCT Application PCT/FR2010/051291, filed Jun. 24, 2010, which claims priority to French Application 0955058, filed Jul. 21, 2009, the entire contents of which are incorporated herein by reference.

BACKGROUND

The invention relates to a device and to a method for working with jets of cryogenic fluid, in particular liquid nitrogen, at high pressure, particularly for the surface treatment, stripping or scalping of coated or uncoated materials such as metals, concrete, wood, polymers, ceramics and plastics or any other type of material.

At the present time, the surface treatment of coated or uncoated materials, particularly the stripping, scalping or the like, is essentially done by sandblasting, by ultra high pressure (UHP) water spray, using a scourer, a pick hammer, a scabbier or alternatively via a chemical route.

However, when there must not be any water, for example in a nuclear environment, or any chemical product, for example because of severe environmental constraints, only so-called "dry" working processes can be used.

However, in certain instances, these "dry" processes are difficult to implement, are very laborious or are awkward to use or even generate additional pollution, for example because of the addition of shot or sand that has then to be reprocessed.

One alternative to these technologies relies on the use of cryogenic jets at very high pressure, as proposed by documents U.S. Pat. No. 7,310,955 and U.S. Pat. No. 7,316,363. In this case, use is made of one or more jets of liquid nitrogen at a pressure of 1000 to 4000 bar and at a cryogenic temperature of between, for example, −100 and −200° C., typically around −140 and −160° C., which are dispensed by a nozzle-holding tool driven in a rotary movement.

More specifically, this nozzle-holding tool is fixed to the end of a cryogenic fluid conveying pipeline which supplies the tool with cryogenic fluid. The pipeline and the tool are then given a rotary movement about the axis of the pipeline by a drive system involving pinions or belts powered by a motor.

The dynamic sealing of the rotary system is usually afforded by a rotary cylindrical sealing joint, typically made of Tivar®, arranged around the pipeline. Typically, this sealing joint of cylindrical shape has a bronze component passing longitudinally through it and is surrounded with a solid stainless steel component.

Because of the cryogenic temperature involved, it has been found in practice that the effectiveness of this sealing joint decreases as time goes on, and this in the fairly short term leads to leaks and therefore loss of process efficiency, particularly during operations of scalping concrete or stripping paint for example.

Specifically, under the effect of the cryogenic temperatures involved, the materials deform in different ways from one another, according to their respective thermal expansion coefficient, as illustrated in table I.

TABLE I

| Thermal expansion coefficient ($\times 10^{-6}$/K) | | |
|---|---|---|
| Tivar ® | Stainless steel | Bronze |
| 180 | 15 | 17.5 |

As may be seen, these materials react very differently to the cryogenic temperatures and as a result, during the alternating cooling and heating cycles, deformations or even damage to the sealing joint occur, and this happens all the more rapidly when the sealing joint is subjected to very high pressures, namely typically of up to 4000 bar.

Specifically, it has been found in practice that a clearance progressively appears between the sealing joint and the metal components and gives rise to leakages which prevent normal operation of the system. As a result of this, it is necessary regularly to change the sealing joint, leading to material and maintenance costs. Now, this is of critical importance in hazardous environments, notably in the nuclear or chemical sectors for example, where human intervention is to kept as infrequent as possible.

Document U.S. Pat. No. 4,369,850 describes a device fitted with a nozzle for dispensing water under pressure which nozzle is arranged at the downstream end of a water pipeline, itself arranged in a rotary cylindrical housing rotationally driven by a motor via a belt and pulley transmission mechanism, in which device the water pipeline is flexible and elbowed so as to be able to dispense a jet of water in a circular path so that holes can be made in the ground, that is to say in earth or the like.

However, that device is not entirely satisfactory because it does not allow the surface area impacted by the jet, at a given distance from the nozzle, to be varied, and this proves to be an appreciable disadvantage in certain applications, notably when stripping or scalping the surface, notably concrete.

A similar device is described elsewhere in DE-A-10236266.

In the light of that, the problem addressed is that of proposing a device for dispensing cryogenic fluid, particularly liquid nitrogen, which is reliable, which means to say with which not only do the problems associated with the wearing of the sealing joint and with leakage not exist, so as to remedy the aforementioned disadvantages but which also allows the area treated by the jet or jets of nitrogen at a given distance from the nozzle to be varied, notably when it is being used for stripping or scalping concrete.

SUMMARY

The solution of the invention is therefore a device for dispensing one or more jets of cryogenic fluid, particularly liquid nitrogen, comprising a fluid conveying pipeline feeding one or more fluid dispensing nozzles arranged at the downstream end of said pipeline, and a motor collaborating with the fluid conveying pipeline via a rotary transmission shaft and a transmission mechanism, in which device:

- the fluid conveying pipeline comprises an upstream portion of first axis XX and a downstream portion of second axis YY, the first and second axes XX, YY between them making an angle $\alpha$ of between 5 and 50°,
- the downstream portion of second axis YY carrying the downstream end of the pipeline with said fluid dispensing nozzle or nozzles, and the transmission mechanism comprises motion-inducing means acting on said downstream portion of pipeline to impart a determined movement to it, characterized in that:

- the transmission mechanism comprises a support pinion capable of rotational movement about a rotation axis situated at the center of said support pinion, the fluid conveying pipeline being positioned eccentrically and running freely through said support pinion, and also a pinion drive means collaborating with the support pinion, and
- the fluid conveying pipeline collaborates with an anchor means arranged on the pipeline upstream of the support pinion, said anchor means forming all or part of a setting system via which it is possible to choose or adjust the length of fluid conveying pipeline measured between the anchor means and the downstream end of said pipeline.

Depending on circumstance, the device of the invention may comprise one or more of the following features:

- the anchor means is designed and able to be attached to or detached from said pipeline so as to hold said pipeline when the anchor means is attached to the pipeline and/or free said pipeline when the anchor means is detached from the pipeline and thus allow the length of pipeline to be set, said length being measured between the anchor means and the downstream end of the pipeline.
- the first and second axes XX, YY between them make an angle $\alpha$ of between 10 and 40°, preferably of the order of 20 to 30°.
- the motion-inducing means act on said downstream portion of pipeline to impart to it a determined movement chosen from rotational and oscillation movements.
- the transmission shaft collaborates with the pinion drive means, and the pinion drive means collaborates with the support pinion in such a way as to transmit, via the pinion drive means, the rotational movement of the transmission shaft to the support pinion and thus obtain a circular movement of the fluid dispensing nozzle or nozzles arranged at the downstream end of said pipeline.
- the transmission mechanism is arranged in a transmission box that the transmission shaft enters.
- the support pinion is held by pinion-holding means comprising one or more slippers or rolling bearings, notably a ball bearing.
- the pipeline is arranged in a passage formed through the body of the support pinion, which passage is situated within the disk formed by the support pinion, but not at the center of said disk.
- holding elements are provided to hold the support pinion, the holding elements being positioned on the pinion at a distance R from the axis of rotation of the pinion which distance is greater than the distance r between the rotation axis and the orifice.
- the holding elements are slippers, radial rolling bearings or spigots and/or in that the pinion drive means is a pinion or a belt.
- the anchor means comprises a clamping device, preferably a clamp, a gland, a split nut, an elastic taper, a rack-pinion system or any other suitable clamping device.
- the pipeline is a stainless steel tube, preferably a flexible tube.
- the end of the tube is removable so that it can easily be replaced, notably in the event of wear.

The invention also relates to the use of a device according to the invention for dispensing, by means of one or more nozzles, a fluid in the form of one or more jets of fluid at a temperature of below −140° C. and at a pressure of at least 1500 bar, preferably between 2000 and 5000 bar, in order, by means of at least one jet of pressurized fluid, to carry out a surface treatment, i.e. a stripping or a scalping treatment on a material, particularly concrete.

Moreover, the invention also relates to a method for stripping or scalping concrete using a jet of liquid nitrogen implementing a device for dispensing one or more jets of liquid nitrogen at a pressure of at least 1500 bar and at a temperature of below −140° C., particularly a device according to the invention, comprising a liquid nitrogen conveying pipeline feeding one or more liquid nitrogen dispensing nozzles arranged at the downstream end of said pipeline, and a motor collaborating with the liquid nitrogen conveying pipeline via a rotary transmission shaft and a transmission mechanism, in which device the liquid nitrogen conveying pipeline comprises an upstream portion of first axis XX and a downstream portion of second axis YY, the first and second axes XX, YY between them making an angle $\alpha$ of between 5 and 50°, the downstream portion of second axis YY carrying the downstream end of the pipeline with said liquid nitrogen dispensing nozzle or nozzles, and the transmission mechanism comprises motion-inducing means acting on said downstream portion of pipeline to impart a determined movement to it, said transmission mechanism comprising a support pinion capable of rotational movement about a rotation axis situated at the center of said support pinion, the liquid nitrogen conveying pipeline being positioned eccentrically and running freely through said support pinion, and also a pinion drive means collaborating with the support pinion.

Depending on circumstance, the method of the invention may comprise one or more of the following features:

- the fluid conveying pipeline collaborates with an anchor means arranged on the pipeline upstream of the support pinion, said anchor means forming all or part of a setting system and the length of fluid conveying pipeline measured between the anchor means and the downstream end of said pipeline is chosen or adjusted by acting on said setting system.
- the anchor means of the setting system is used respectively to attach it to or detach it from said pipeline in order respectively to hold said pipeline or to free said pipeline and thus allow the length of pipeline to be set.
- the jets of fluid are at a pressure of between 1000 and 5000 bar, preferably of at least 2000 bar.
- the fluid is at a temperature of below −140° C., preferably of between −150 and −200° C.

The method of the invention can be implemented by hand, that is to say by an operator, or alternatively can be implemented automatically or in an automated way, that is to say by a machine or by a robot.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
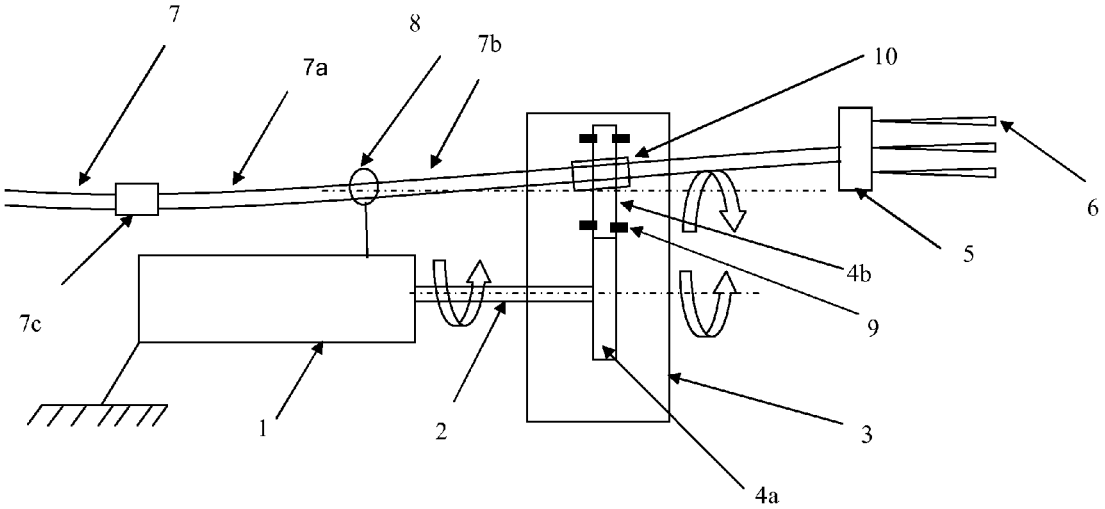
FIG. 1 is a schematic (side) view of a high-pressure fluid jet dispensing device according to the present invention.

FIG. 1 illustrates the principle of a device for dispensing jets of fluid, preferably a fluid at cryogenic temperature and at high pressure according to the present invention. This device comprises a fluid conveying pipeline 7, such as a stainless steel tube, supplying one or more fluid dispensing nozzles arranged at the downstream end of said pipeline 7. In general, the nozzles are carried by a nozzle-holding tool 5.

According to one embodiment, the fluid that is to be dispensed is a fluid at cryogenic temperature and at high pressure, particularly liquid nitrogen at a pressure of between 1000 and 4000 bar and at a temperature of between −140 and −200° C. The fluid being taken from a fluid source (not shown) such as a compressor, a tank, a heat exchanger, a supply line, one or more gas cylinders or the like, supplying the upstream end of the fluid pipeline 7.

Figure 3:
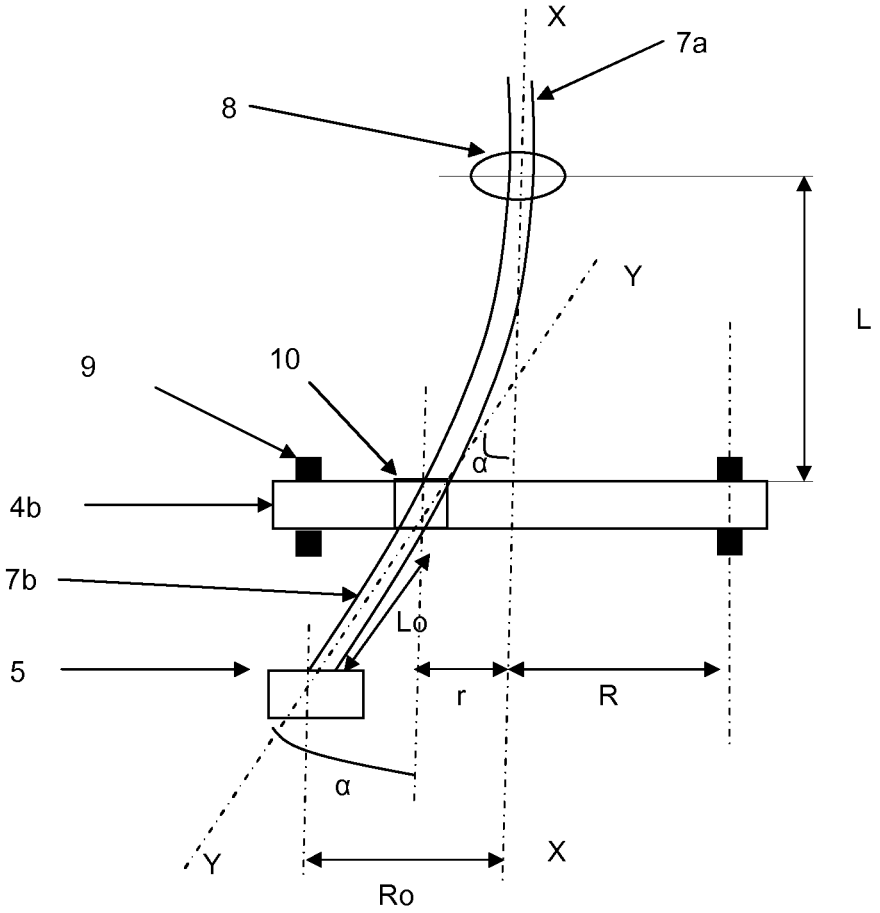
FIG. 3 is a schematic (side) view of the support pinion and of the high-pressure tube of a device according to FIG. 1.

As illustrated in FIG. 3, the fluid conveying pipeline 7 of the fluid dispensing device collaborates with a motor 1 via a rotary transmission shaft 2 and a transmission mechanism 4*a*, 4*b* which will be detailed hereinafter.

The fluid conveying pipeline 7 for its part comprises an upstream portion 7*a* of first axis XX and a downstream portion 7*b* of second axis YY between them making an angle $\alpha$ of between 5 and 50°, typically of between 10 and 40° and preferably of the order of 20 to 30°.

The downstream portion 7*b* carries the downstream end of the pipeline 7 where the fluid dispensing nozzle or nozzles is or are arranged, for example on a nozzle-holding tool.

Moreover, the transmission mechanism 4*a*, 4*b* comprises motion-inducing means acting on the downstream portion 7*b* of pipeline so as to impart to it a determined movement, of whatever kind it might be, particularly a rotational or oscillatory movement. What should be understood by rotational movement is a movement which describes a circle or an ellipse, for example. The choice of the design of the component 4*b* will determine the type of movement chosen.

The motor 1 collaborating with the fluid conveying pipeline 7 via its rotary transmission shaft 2 and the transmission mechanism 4*a*, 4*b* to which the transmission shaft 2 transmits its rotational movement. The motor is a pneumatic motor, an electric motor, a gasoline engine or any other type of motor.

Figure 2:
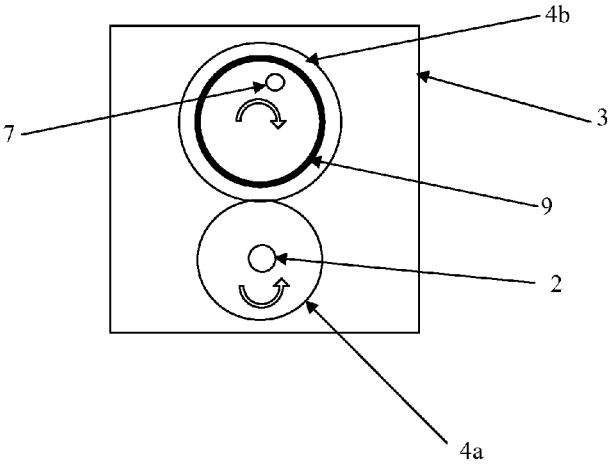
FIG. 2 is a schematic (front) view of the support and drive pinions of a device according to FIG. 1.

According to the invention, as visible in FIG. 2, the transmission mechanism 4*a*, 4*b* comprises a support pinion 4*b* capable of a rotational movement about an axis of rotation located at the center of said support pinion 4*b*, and the cryogenic fluid conveying pipeline 7 being positioned eccentrically through said support pinion 4*b*. In other words, the axis of the pipeline 7 and the axis of the support pinion 4*b* are non-coincident.

The pipeline 7 is therefore arranged in a passage or orifice 10 formed through the body of the support pinion 4*b*, which passage is situated within the disk that the support pinion 4*b* forms, but not at the center of said disk.

For preference, the passage for the pipeline 7 is situated at least 1 mm away from the center of the pinion, which means to say from the axis of said support pinion 4*b*.

Moreover, a pinion drive means 4*a*, such as a drive pinion or a belt, collaborates with the support pinion 4*b* to drive the rotational movement of said support pinion 4*b*. More specifically, the transmission shaft 2, driven by the motor 1, collaborates with the pinion drive means 4*a* and the pinion drive means 4*a* itself collaborates with said support pinion 4*b* in order, via the pinion drive means 4*a*, to transmit the rotational movement of the transmission shaft 2 to the support pinion 4*b* and thus obtain a movement, preferably a circular movement, of the fluid dispensing nozzle or nozzles arranged at the downstream end of said pipeline 7, that is to say arranged on the nozzle-holding tool 5 used for dispensing the jets 6 of high-pressure fluid.

As illustrated in FIG. 1, a transmission box 3 that forms a protective casing and that the transmission shaft enters and that houses the transmission mechanism 4*a*, 4*b*. In this transmission box 3 the pinion 4*b* is held in place by a set of slippers or by rolling bearings of any type, for example needle bearings or ball bearings, preferably ball bearings.

Figure 4:
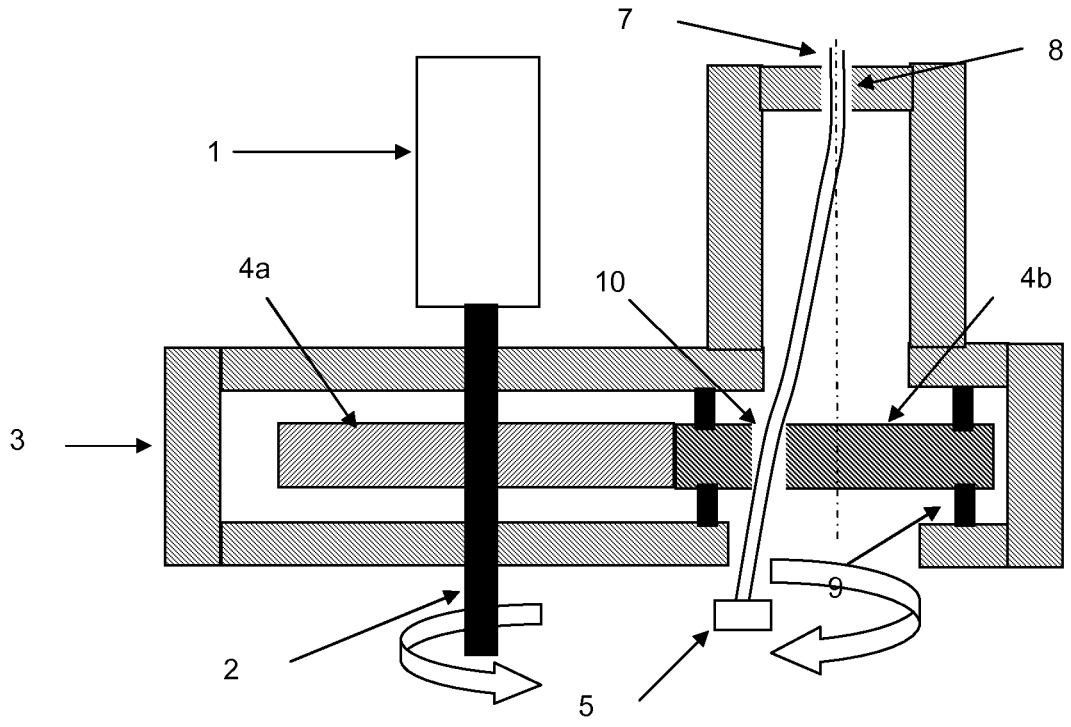
FIG. 4 depicts details of the pinion-holding means.

The support pinion 4*b* is held by pinion-holding means 9 comprising one or more slippers or rolling bearings, notably a ball bearing as schematically illustrated in FIG. 4.

It should be noted that elements 9, such as slippers, radial rolling bearings or spigots, are provided to maintain good rotation of the support pinion 4*b*. In fact, the support pinion 4*b* is grooved to accept the elements 9. The support pinion 4*b* is not held on its shaft. The pinion 4*b* is held by devices 9 which are positioned on the pinion 4*b* at a distance R from the axis of rotation of the pinion 4*b* which distance is greater than the distance r between the axis of rotation and the orifice 10, as illustrated in FIG. 3.

Moreover, the fluid conveying pipeline 7 collaborates with anchor means 8, such as a gland, a clamp, a split nut, an elastic taper, a rack-pinion system or any other suitable mechanical device allowing the pipeline 7 to be held in position with respect to the rest of the jet dispensing device, said anchor means 8 being arranged on the pipeline 7 upstream of the support pinion 4*b*, i.e. the support pinion 4*b* is situated between the anchor means 8 and the end of the pipeline 7 bearing the nozzle or nozzles. In other words, the pipeline 7 is, on the one hand, kept stationary or approximately stationary in the region and because of the anchor means 8 and, on the other hand, comprises a downstream end 7*b* fitted with the nozzle or nozzles which is able to move and describes a given movement, preferably a circular movement, when the motor 1 drives the transmission shaft 2, the drive pinion 4*a* connected to the shaft 2, and the support pinion 4*b* which itself drives the tube 7 in a determined path, for example a circular path or the like.

The anchor point 8 is a mechanical element that allows the sliding of the pipeline 7 though the device and ultimately through the passage 10 to be blocked or unblocked.

The anchor point therefore makes it possible, for the time that the method is being implemented, to fix the length Lo, and therefore the diameter or the like of the circular path or the like described by the nozzle, in the knowledge that the distance between the anchor point 8 and the pinion 4*b* is fixed. Stated differently, modifying the length Lo is particularly advantageous for varying the radius of the circular path Ro described by the nozzle or nozzles for dispensing jets of high-pressure fluid as illustrated in FIG. 3.

The mechanical element of the anchor point can be slackened off easily by the user, for example using an appropriate tool, if the user wishes to set or adjust the length Lo.

If the pipeline 7 is positioned on a movement machine or on a robot, it may prove difficult or impractical to slide the tube 7 through the device. It is therefore beneficial for the pipeline 7 to be split into two parts connected by a very-high-pressure static coupling 7*c* positioned upstream of the anchor point 8. This allows this part of the tube between 7*c* and the nozzle-holding tool 5 to be changed easily for a tube of suitable length allowing Lo to be adjusted to the desired length without the entirety of the tube 7 having to be moved or modified.

Furthermore, because this part of the pipeline is subject to deformation, it is preferable for it to be readily interchangeable for maintenance purposes.

In order to obtain sufficient pipeline 7 elastic deformation (flexibility), the properties of said pipeline 7, or at least of the part 7*b* of pipeline 7 situated between the anchor means 8 and the end carrying the nozzle-holding tool 5, are chosen with care, particularly the nature of the material of which the tube 7 is made, and its sizing, i.e. the inside and outside diameters of said tube.

For example, if it is a cryogenic fluid such as liquid nitrogen under high pressure that is being conveyed, use is preferably made of a stainless steel tube by way of pipeline 7, with inside and outside diameters as given in table II below.

TABLE II

| Tube diameter | | | |
|---|---|---|---|
| outside | 6.4 mm (¼") | 9.5 mm (⅜") | 14.8 mm (9/16") |
| inside | 2.1 mm | 3.2 mm | 4.8 mm |
| Rcmin = minimum bend radius in meters without plastic deformation | 1 to 1.5 m | 2 to 2.5 m | R to great to conceive of any flexibility |

As can be seen from table II, the 14.8 mm diameter tube is too rigid to be used to effect. Hence, typically, use is made of a tube in 316 grade stainless steel able to withstand high pressures (up to around 4000 bar) with an outside diameter of around 6.4 mm.

Figure 5:
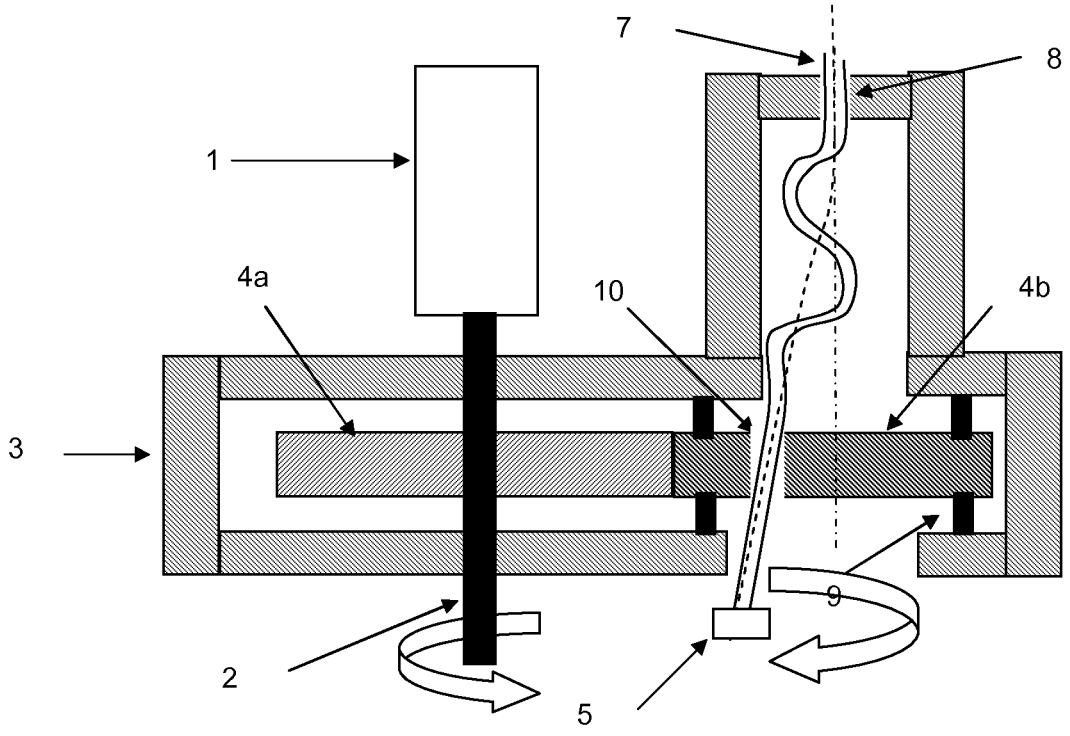
FIG. 5 depicts an embodiment with a pigtail system.

In order to make the tube still more flexible, it is possible to give said tube the form of a loop or pigtail, as shown in FIG. 5, or to use a bellows system.

Likewise, in order to ensure freedom of movement between the pinion 4*b* and the tube 7 at the orifice 10, a ball bearing or similar system may advantageously be positioned at 10 around the flexible tube 7.

A device according to the invention comprising a stainless steel tube with an external radius of 6.4 mm, supplied with liquid nitrogen at a temperature of −155° C. and at a pressure of 3500 bar, was tested without fatigue rupture over 2 000 000 cycles at a very high rotational speed of around 1100 rpm. Thus, according to the person skilled in the art of fatigue mechanics, the tube will not rupture through fatigue, whatever the number of cycles performed, particularly in excess of 2 000 000 cycles. The results obtained are therefore entirely satisfactory and the device works perfectly.

Figure 6:
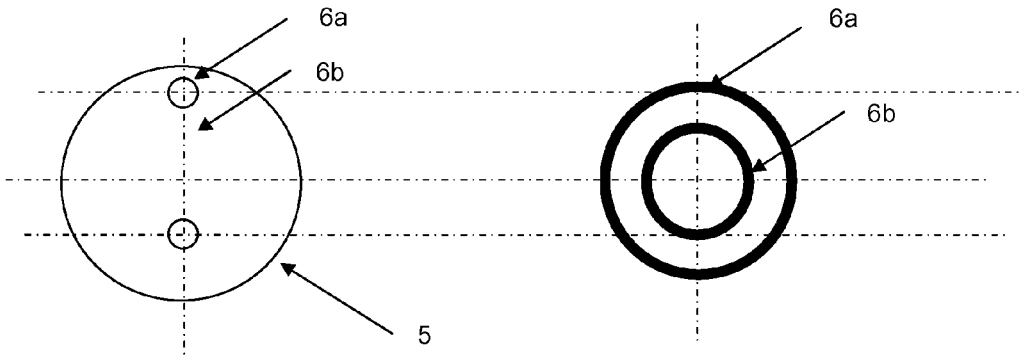
FIG. 6 depicts a nozzle-holding tool with the path of the jets for a tool of the prior art.
Figure 7:
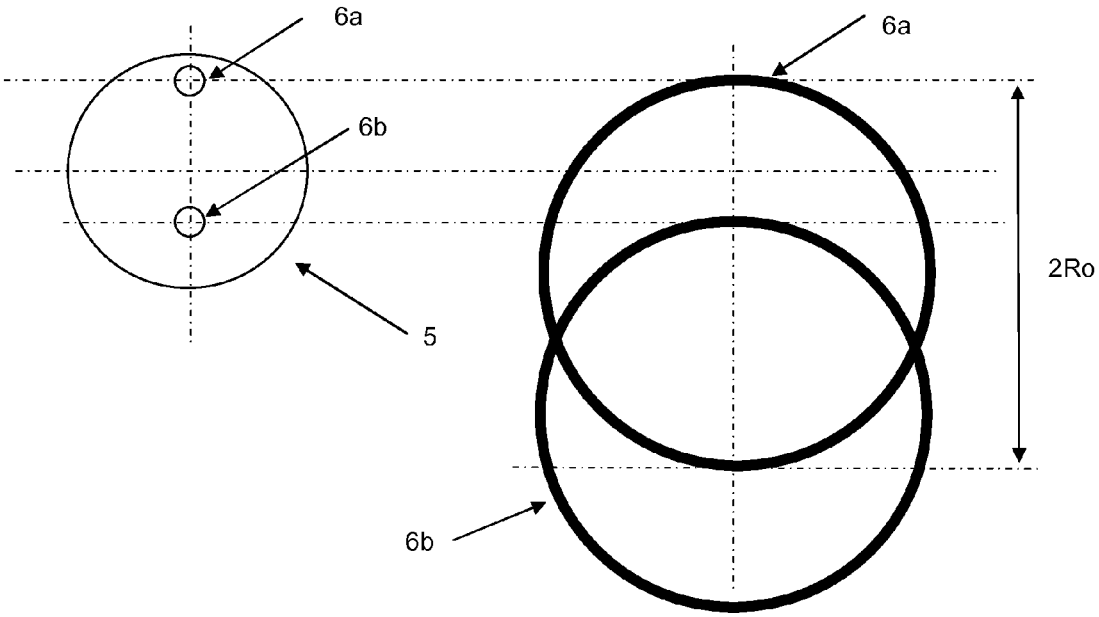
FIG. 7 depicts a nozzle-holding tool with the path of the jets for a tool according to the present invention.

It is to be noted that a device according to the invention will not exactly reproduce the path of the jets followed by the systems used previously. A nozzle holder equipped with two nozzles used with the system described in U.S. Pat. No. 7,316,363 gives the two nozzles concentric circular paths with different radii, as illustrated in FIG. 6, whereas the same nozzle holder equipped with the same two nozzles gives the nozzles circular paths with identical radii Ro but which are offset, as schematically illustrated in FIG. 7.

The circles (FIG. 7) described by the liquid nitrogen jets will have a diameter that increases with increasing Lo and increasing α. Thus, for a surface treatment or scalping of concrete for example, the output will therefore be greater because the surface area described will be greater.

Figure 8:
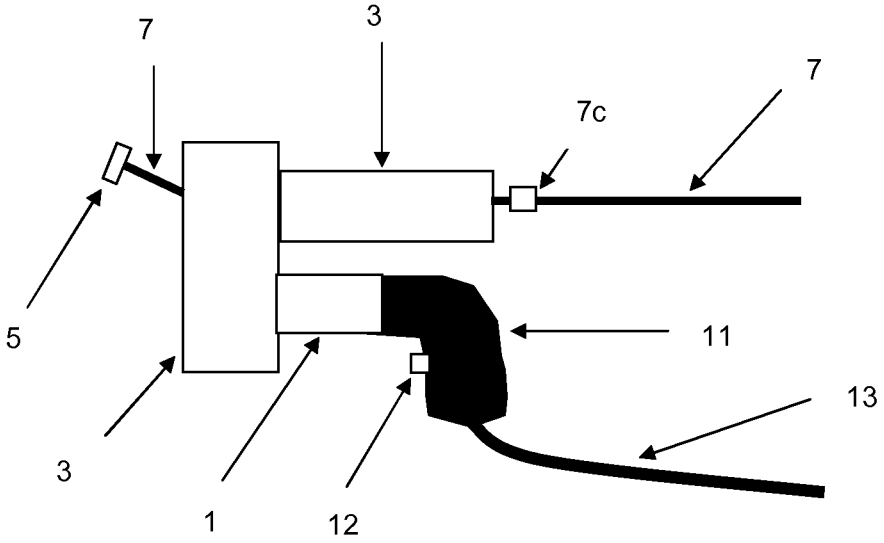
FIG. 8 depicts a manual tool according to the present invention.
Figure 9:
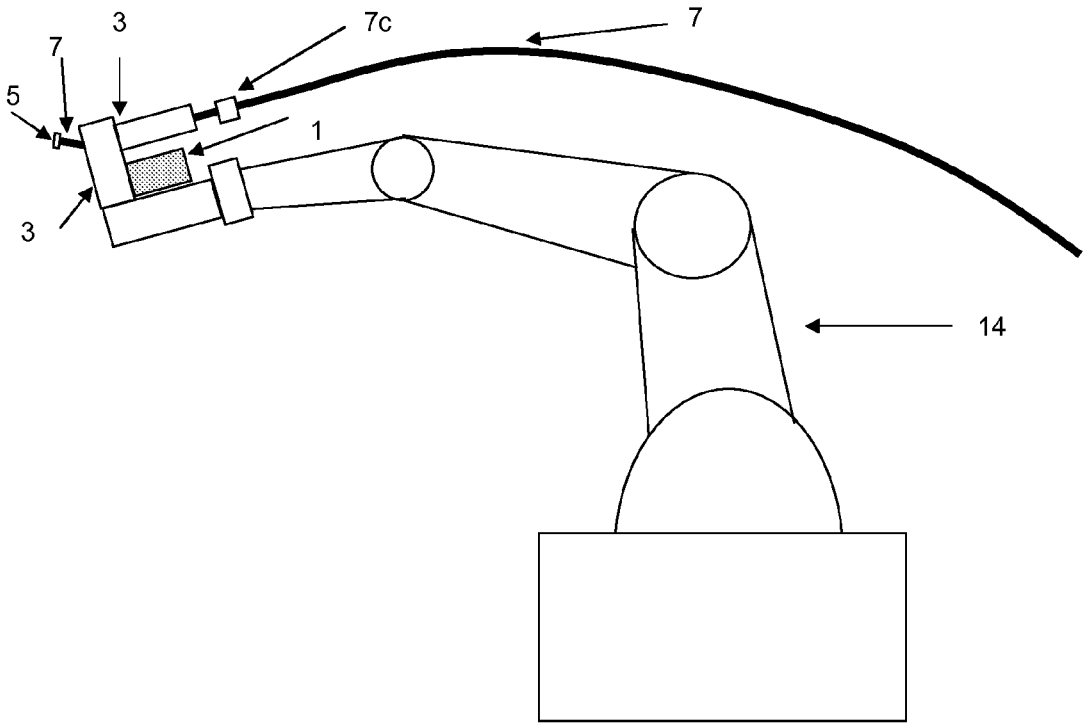
FIG. 9 depicts an automatic tool according to the present invention incorporated into a robot.

The device of the invention can be used for a manual application, as shown in FIG. 8, or an automatic or robotic application as shown in FIG. 9.

More specifically, FIG. 8 schematically illustrates an example of a manual tool comprising a pneumatic motor 1 fitted with a handle 11, a trigger 12 and a compressed air inlet hose 13, whereas FIG. 9 shows an example of an automatic tool with an electric motor 1, mounted on a robot 14. The automatic tool can also be used with a mobile device having one or more axes of movement.

The device of the present invention can be applied to any heat treatment operation or process that involves rotating jets of fluid, particularly cryogenic fluids, such as surface treatment, stripping or scalping of a material, such as metals, concrete, stone, plastics, wood, ceramic, etc.

The invention claimed is:

1. A device for dispensing one or more jets of fluid (6) comprising a fluid conveying pipeline (7) configured to feed a fluid to one or more fluid dispensing nozzles (5) arranged at the downstream end of said pipeline (7), and a motor (1) collaborating with the fluid conveying pipeline (7) via a rotary transmission shaft (2) and a transmission mechanism (4*a*, 4*b*), in which device:

the fluid conveying pipeline (7) comprises an upstream portion (7*a*) of first axis (XX) and a downstream portion (7*b*) of second axis (YY), the first and second axes (XX, YY) between them making an angle (α) of between 5 and 50°, the downstream portion (7*b*) of second axis (YY) comprising the downstream end of the pipeline (7) with said fluid dispensing nozzle or nozzles, and wherein the transmission mechanism (4*a*, 4*b*) comprises motion-inducing elements capable of acting on said downstream portion (7*b*) of pipeline to impart a determined movement to it, further wherein the transmission mechanism (4*a*, 4*b*) comprises:

a support pinion (4*b*) capable of rotational movement about a rotation axis situated at the center of said support pinion (4*b*), the fluid conveying pipeline (7) being positioned eccentrically and running freely through said support pinion (4*b*), and a pinion drive (4*a*) collaborating with the support pinion (4*b*), and the fluid conveying pipeline collaborates with an anchor (8) arranged on the pipeline upstream of the support pinion (4*b*), said anchor (8) forming all or part of a setting system configured to allow adjustment the length of fluid conveying pipeline between the anchor (8) and the downstream end of said pipeline (7).

2. The device as claimed in claim 1, wherein the anchor (8) is designed and able to be attached to or detached from said pipeline (7) so as to hold said pipeline (7) when the anchor is attached to the pipeline (7) or free said pipeline when the anchor is detached from the pipeline (7) and thus allow the length of pipeline (7) to be set, said length being measured between the anchor means (8) and the downstream end of the pipeline (7).

3. The device of claim 1, wherein the first and second axes (XX, YY) between them make an angle (α) of between 10 and 40°.

4. The device of claim 1, wherein a transmission shaft (2) collaborates with the pinion drive (4*a*), and the pinion drive (4*a*) collaborates with said support pinion (4*b*) in such a way as to be capable of transmitting, via the pinion drive (4*a*), the rotational movement of the transmission shaft (2) to the support pinion (4*b*) and thus obtain a circular movement of the fluid dispensing nozzle or nozzles arranged at the downstream end of said pipeline (7).

5. The device of claim 1, wherein the support pinion (4*b*) is held by pinion-holding elements comprising one or more slippers or rolling bearings.

6. The device of claim 1, wherein the pipeline (7) is arranged in a passage (10) formed through the body of the support pinion (4*b*), which passage (10) is situated within a disk formed by the support pinion (4*b*), but not at the center of said disk.

7. The device of claim 1, wherein holding elements (9) are provided to hold the support pinion (4*b*), the holding elements (9) being positioned on the support pinion (4*b*) at a distance R from the axis of rotation of the support pinion (4*b*) which distance is greater than the distance r between the rotation axis and an orifice of a passage (10).

8. The device of claim 7, wherein the holding elements (9) are slippers, radial rolling bearings or spigots and/or the pinion drive (4*a*) is a pinion or a belt.

9. The device of claim 1, wherein the anchor (8) comprises a clamping device, a gland, a split nut, an elastic taper or a rack-pinion system.

10. The device of claim 1, wherein the pipeline (7) is a stainless steel tube.

* * * * *